US006776579B2

(12) United States Patent
Shiratori et al.

(10) Patent No.: US 6,776,579 B2
(45) Date of Patent: Aug. 17, 2004

(54) FAN

(75) Inventors: Norihiko Shiratori, Nagano (JP); Kazutoyo Ichikawa, Nagano (JP); Hideki Tamura, Nagano (JP)

(73) Assignee: MicroStone Co., Ltd., Kitasaku-gun (JP)

( * ) Notice: Subject to any disclaimer, the term of this patent is extended or adjusted under 35 U.S.C. 154(b) by 0 days.

(21) Appl. No.: 10/142,939

(22) Filed: May 13, 2002

(65) Prior Publication Data

US 2002/0172597 A1 Nov. 21, 2002

(30) Foreign Application Priority Data

May 15, 2001 (JP) ..... 2001-182570
Sep. 20, 2001 (JP) ..... 2001-328400
Feb. 18, 2002 (JP) ..... 2002-082066

(51) Int. Cl.[7] ..... A45B 27/00
(52) U.S. Cl. ..... 416/5; 416/70 A; 416/71

(58) Field of Search ..... 416/5, 69, 70 R, 416/71, 70 A, 72, 73, 142, 146 R

(56) References Cited

U.S. PATENT DOCUMENTS 3,984,707 A * 10/1976 McClintock ..... 310/15
5,222,795 A * 6/1993 Hed ..... 362/558

FOREIGN PATENT DOCUMENTS

JP 04364804 A * 12/1992 ..... A45B/27/00
JP 07327720 A * 12/1995 ..... A45B/27/00
JP 08056728 A * 3/1996 ..... A45B/27/00

* cited by examiner

*Primary Examiner*—Edward K. Look
*Assistant Examiner*—Richard A. Edgar
(74) *Attorney, Agent, or Firm*—Dennison, Schultz, Dougherty & MacDonald

(57) ABSTRACT

A fan comprises a fan body and a handle secured to the fan body. The fan body is made of a transparent sheet. An LED is provided in the handle for illuminating the fan body. Batteries are mounted in the handle for operating the LED.

23 Claims, 11 Drawing Sheets

FAN

BACKGROUND OF THE INVENTION

The present invention relates to a fan which is swung by hand creating a cooling current of air.

Although there have been proposed various fans of the above described type, each of these fans has disadvantages that emitted light is defective in delicacy and elegance.

SUMMARY OF THE INVENTION

An object of the present invention is to provide a fan which has beautiful radiation of light and various light emission effects, and may be manufactured at low cost.

According to the present invention, there is provided a fan comprising a fan body made of a transparent sheet, a gripping member provided at a base portion of the fan body so as to be gripped by a hand of a user for swinging the fan body, an LED for illuminating the fan body, and a source for operating the LED.

The fan body is made of resin.

The gripping member is a handle secured to the fan body.

The source is at least one battery.

The source may be a generator generating electric current by motion of the fan body.

The fan further comprising a skeleton provided in the fan body.

The fan body has irregular portions and a pattern to be illuminated by light emitted from the LED.

A shield member is provided for shielding leaking light of the LED.

The LED is disposed at the base portion of the fan body.

A motion sensor is provided in the handle for detecting the motion of the fan body to control light emitting condition of the LED.

The source is provided in the handle.

The generator may be provided in the fan body.

The generator comprises a coil and a permanent magnet which is provided to be moved with respect to the coil These and other objects and features of the present invention will become more apparent from the following detailed description with reference to the accompanying drawings.

DETAILED DESCRIPTION OF THE PREFERRED EMBODIMENT

Figure 1:
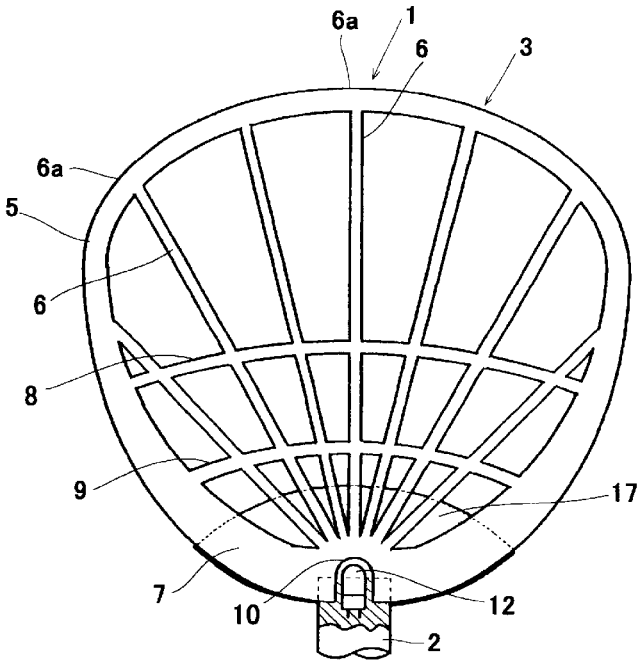
FIG. 1 is a plan view showing a first embodiment of the present invention.
Figure 2:
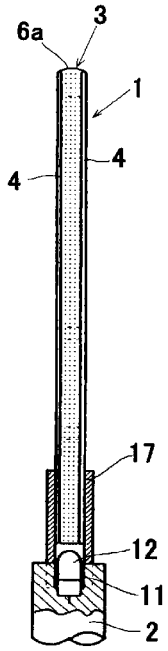
FIG. 2 is a sectional view.
Figure 3:
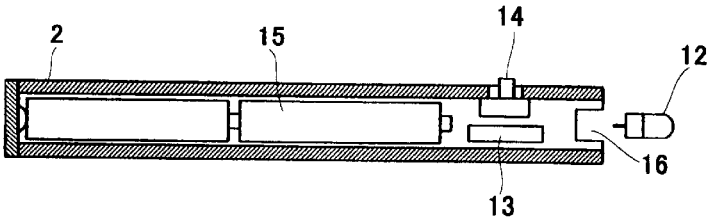
FIG. 3 is a sectional view of a handle.

Referring to FIGS. 1 through 3, a fan according to a first embodiment of the preset invention comprises a fan body 1 and a handle 2 formed at a side of the fan body as a gripping member for swinging the fan body.

The fan body 1 comprises a skeleton 3 made of colorless transparent plastic and a pair of sheets 4 made of transparent plastic film and adhered on both sides of the skeleton 3 with adhesive. In FIG. 1, the sheet 4 is removed.

The skeleton 3 comprises an annular frame 5, a plurality of radial ribs 6 integral with the frame 5 and radially extending from a base portion 7, and arcuated lateral ribs 8 and 9. Both side surfaces of the skeleton 3 are flat. The sheet 4 covers the whole area of the skeleton 3.

There is formed a space between sheets 4 at a portion adjacent ribs 6.

The handle 2 is made of plastic and has a cylindrical shape. There are formed recesses 10 and 11 in the base portion 7 and the end of the handle 2. A LED (light emitting diode) 12 is mounted in the recesses 10 and 11. In the handle 2, a circuit 13 for operating the LED, a switch 14 for closing the circuit 13 to emit light, and a source 15 comprising batteries are mounted.

The handle 2 has a pair of recesses 16 in which the base portion 7 of the fan body 1 is inserted and secured thereto with adhesive. A light shielding layer 17 made of opaque resin is provided around the base portion 7 for preventing the light of the LED 12 from leaking at the base portion 7.

When the push button of the switch 14 is depressed to close the circuit, the LED 12 is operated to emit light. The emitted light passes through the radial ribs 6. If there is not provided irregular portions such as illuminated foreign things or parts in the ribs, the surface of the fan does not brighten. The light illuminates the end face 6*a* of each rib 6, thereby brightening the end face. If the LED emits a color light, for example blue light, the end face brightens in blue.

If there is provided irregular parts different in sectional area of the rib 6, engraved patterns on the rib, or particles in the rib, these parts are illuminated to brighten.

Figure 4:
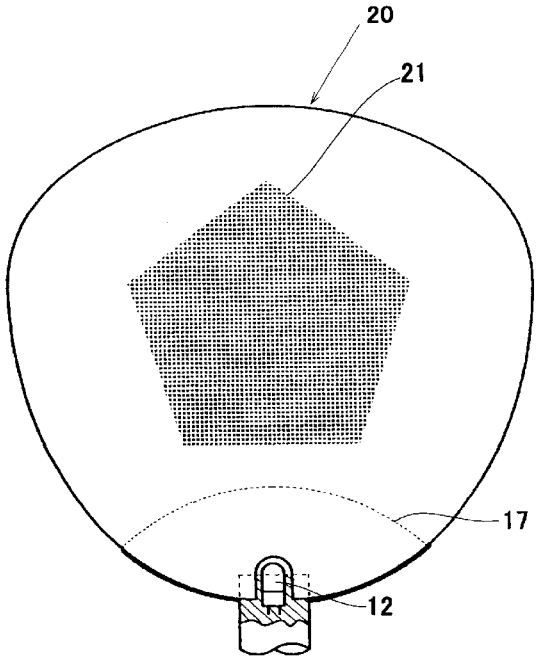
FIG. 4 is a plan view showing a second embodiment of the present invention.
Figure 5:
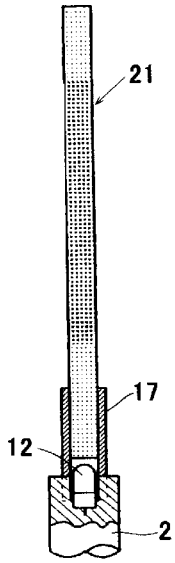
FIG. 5 is a sectional view thereof.

FIG. 4 is a plan view showing a second embodiment of the present invention, and FIG. 5 is a sectional view thereof.

A fan body 20 is made of acrylic resin in uniform thickness without ribs. A pattern 21 is formed in the fan body 20 by laser processing. The pattern is provided by a plurality of fine cracks.

Thus, each crack is illuminated by the light from the LED 12 to be brightened, thereby the pattern 21 is embossed. More particularly, the cracks diffusely reflect the light so that the pattern brightens beautifully.

The other parts are the same as that of the first embodiment and identified by the same reference numerals as FIGS. 1 to 3.

Figure 6:
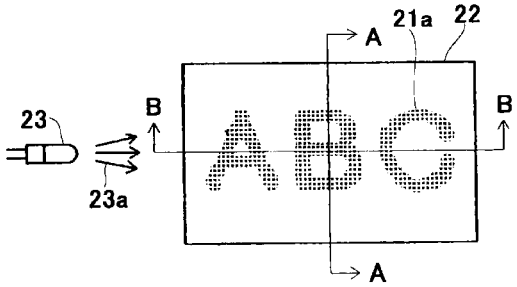
FIGS. 6 to 8 are illustrations for explaining the method for making the pattern on the fan body.
Figure 7:
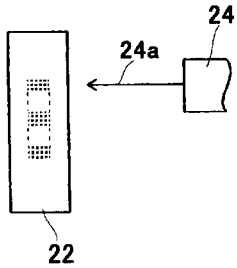
Figure 8:
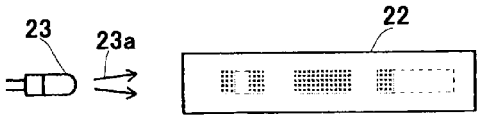

FIGS. 6 to 8 are illustrations for explaining the method for making the pattern on the fan body.

There is provided a transparent plate 22 made of acrylic resin and a laser emitting device 24 opposite to the plate 22. The laser emitting device 24 emits YAG laser (yttrium aluminum garnet laser) 24*a*. The laser emitting device 24 is moved along patterns 21*a*, so that the patterns are formed by a plurality of cracks. The frequency of the laser beam has a large effect on the accuracy of the pattern formation. If the frequency is lower than 20 KHz, the pattern blurs. It is preferable that the frequency of the laser beam is between 40 and 50 KHz.

Referring to FIGS. 6 and 8, an illuminating light source 23 emits illuminating light beams 23*a* against the left side of the plate 22. The light beams 23*a* are diffusely reflected from the cracks, thereby beautifully embossing the patterns 21*a*.

Figure 9:
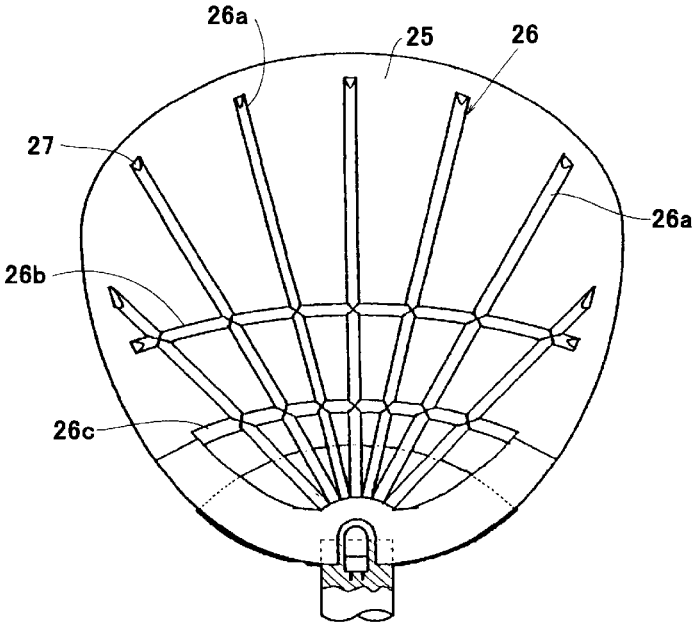
FIG. 9 is a plan view of a fan of the third embodiment of the present invention.
Figure 10:
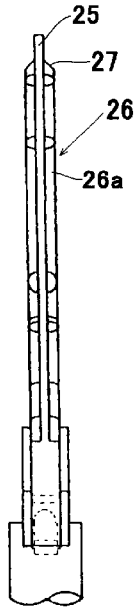
FIG. 10 is a side view of the fan of the third embodiment.

FIG. 9 is a plan view of a fan of the third embodiment of the present invention, and FIG. 10 is a side view.

The fan comprises a thin fan plate 25 and ribs 26 integral with the fan plate 25. The rib 26 is formed on both sides of the fan plate 25 by plastic molding. The rib 26 comprises radial ribs 26*a* and lateral ribs 26*b* and 26*c*. The end of each of the ribs 26*a* and 26*b* has an inclined surface 27, thereby outwardly emitting light. The base portion of each radial rib 26*a* has a larger thickness so as to increase the strength of the base portion.

Figure 11:
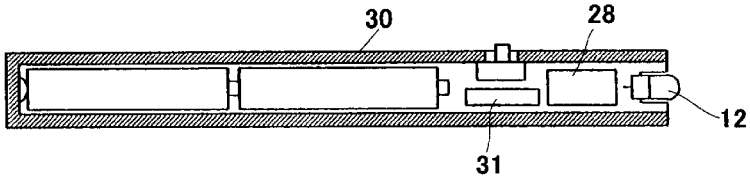
FIG. 11 is a sectional view of a handle of the fourth embodiment of the present invention.

FIG. 11 is a sectional view of a handle of the fourth embodiment of the present invention. A motion sensor 28 is mounted in a handle 30. The motion sensor 28 is provided for detecting the acceleration of the motion of the fan by a vibrating body made of piezoelectric element, or detecting the angular velocity of the motion of the fan by Coriolis force of the vibration gyro sensor.

In accordance with the output of the motion sensor 28, a control circuit 31 controls the condition of emitted light of the LED 12 including luminous intensity.

Figure 12:
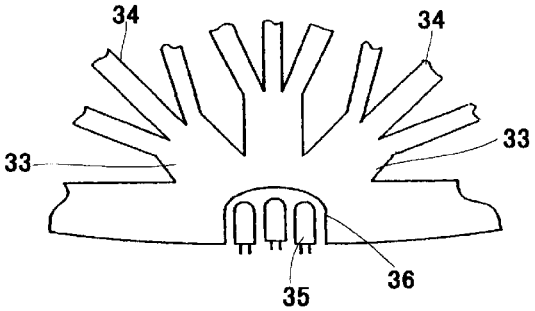
FIG. 12 is a plan view showing a part of a skeleton according to the fifth embodiment of the present invention.

FIG. 12 is a plan view showing a part of a skeleton according to the fifth embodiment of the present invention.

The skeleton comprises thick radial base ribs 33 and radial thin ribs 34 projected from the top of each of the thick radial base ribs 33. In a recess 36 at the base portion of the skeleton three LEDs 35 are provided. The LEDs 35 are different in color, for example divided into the three primary colors.

The three colors are mixed in the base ribs 33, and the mixed color is divided into thin ribs 34. Thus, the skeleton brightens in various colors.

Figure 13:
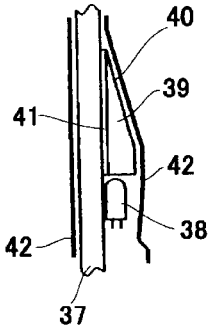
FIG. 13 is a sectional view of a base portion of a fan according to the sixth embodiment of the present invention.

FIG. 13 is a sectional view of a base portion of a fan according to the sixth embodiment of the present invention.

The fan comprises a base portion 37 of a skeleton, an LED 38 mounted on one of the sides of the base portion 37, a light leading member 39 having a slant light leading plane 40 and fixed to the base portion 37 with a transparent adhesive 41, opposite to the LED 38, and a light shielding layer 42 covering an area around the LED 38 and light leading member 39.

Light emitted from the LED 38 is guided by the light leading plane 40 and directed to the skeleton, passing through the transparent adhesive 41. There is not provided a recess for mounting the LED.

Figure 14:
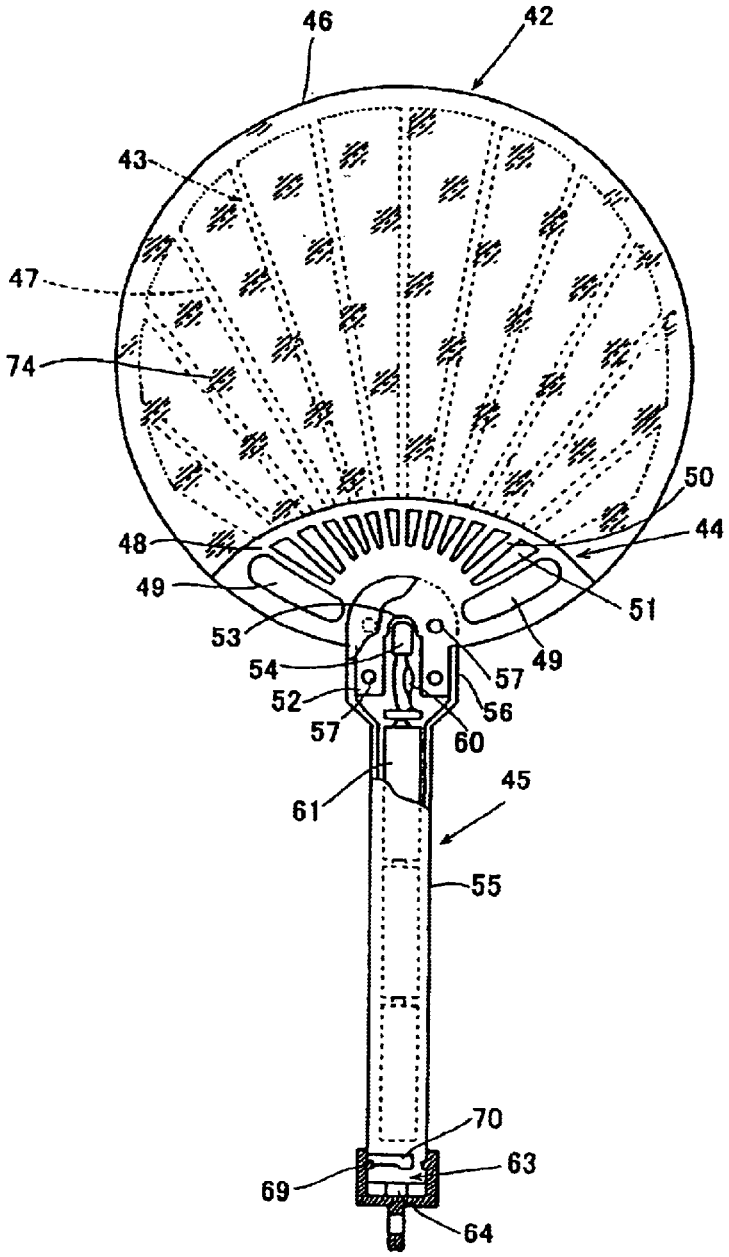
FIG. 14 is a plan view showing a fan of the seventh embodiment of the present invention.
Figure 15:
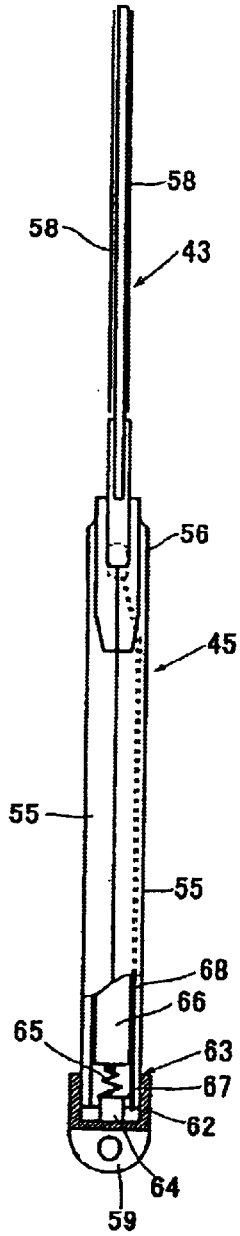
FIG. 15 is a side view.
Figure 16:
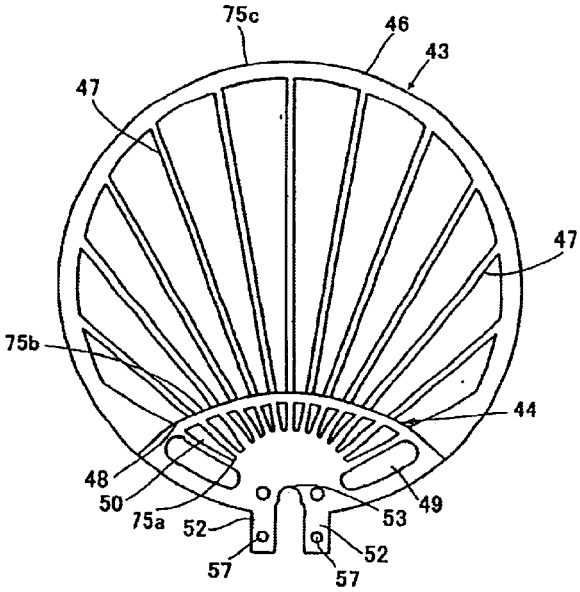
FIG. 16 is a plan view showing a skeleton.
Figure 17:
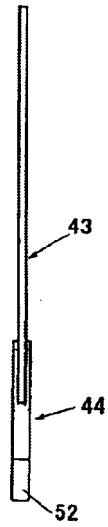
FIG. 17 is a side view of the skeleton.
Figure 18:
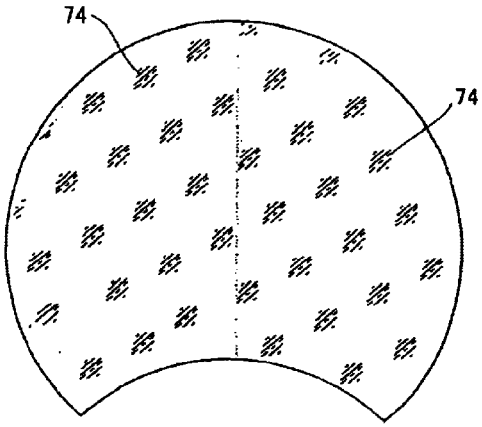
FIG. 18 is a plan view showing a sheet.

FIG. 14 is a plan view showing a fan of the seventh embodiment of the present invention, FIG. 15 is a side view, FIG. 16 is a plan view showing a skeleton, FIG. 17 is a side view of the skeleton, FIG. 18 is a plan view showing a sheet.

Referring to FIGS. 14 and 16, a fan body 42 has a skeleton 43 and a base portion 44 integral with the skeleton 43, which are made of transparent plastic sheets 58 adhered to both sides of the skeleton 43, and a handle 45. The skeleton 43 comprises a circular frame 46 and a plurality of radial ribs 47 extending from the base portion 44 to the frame 46.

The base portion 44 comprises an eye shaped frame 48, a plurality of quasi-ribs 50, a plurality of recesses 51 between the quasi-ribs 50, and a pair of windows 49 formed at both end portions. A pair of connecting projections 52 are formed on the underside of the base portion 44, forming a U-shaped injection portion 53.

The handle 45 is formed by a pair of elongated shells 55 and has holding portions 56 at an end portion. In the injection portion 53, an LED 54 is mounted. Fixing pins (not shown) projected from the inside wall of the holding portion 56 are engaged with holes 57 of the base portion 44, thereby fixing the holding portions 56 to the base portion.

In the handle, a resistor 60 is provided to connect one of terminals of the LED 54 to positive pole of an uppermost battery 61.

On a bottom of the handle 45, a pendant 59 is rotatably mounted, and a switch 63 is provided in a cap 62. On the bottom plate of the cap 62, a base member 64 is secured, and a coil spring 65 is fixed on the base member 64. The upper end of the spring 65 is pressed against a negative pole of a lower most battery 66, and a lower portion of the spring 65 is radially extended to form a switch contact blade 67. The switch contact blade 67 is adapted to be contacted with a lower end portion of a lead 68 extending from the other terminal of the LED 44 as described hereinafter.

The cap 62 has a pair of projections 69 projected from an inside wall thereof. The projections 69 engage with a cam groove 70 formed on the outside wall of the handle 45 in the circumferential direction.

Figure 19:
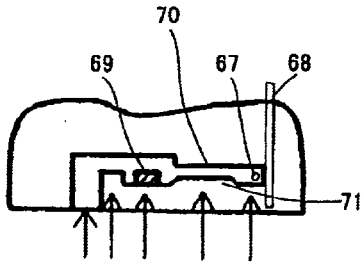
FIG. 19 is a development of a cam groove.

FIG. 19 is a development of the cam groove 70. The cam groove 70 has a lobe 71. In the open condition of the switch 63, one of the projections 69 is positioned at a position A. When the cap 62 is rotated in the clockwise direction, the projection 69 gets over a wall B and enters a recess gets over the lobe 71 (D position) and drops to a recess E. At the E position, the projection 69 presses the contact blade 67 of the spring 65 against the end portion of the lead 68, thereby closing the switch 63 to operate the LED 44.

The sheet 58 made of plastic is adhered to both sides of the skeleton 43. There is formed a plurality of patterns 74 on the surface of the sheet 58. It is preferable to make the sheet 58 by a hologram sheet.

The hologram sheet comprises a resin sheet made of colorless transparent soft resin such as PET (polyethylene terephtalate), PVC (polyvinyl chloride), OPP (oriented polypropylene) and others, fine bosses formed on the underside of the sheet by embossing process for interfering reflected light, and a thin aluminum film formed on the embossed surface by vacuum deposition. When illuminated, the hologram sheet radiates in various colors at the patterns 74.

Referring to FIG. 16, there is a plurality of brightening points 75*a*, 75*b*, 75*c*. Thus, whole surface of the fan brightens. Although the holding portion 56 shields leaking light, it is preferable to slightly leak the light, thereby increasing brightening points.

Figure 20:
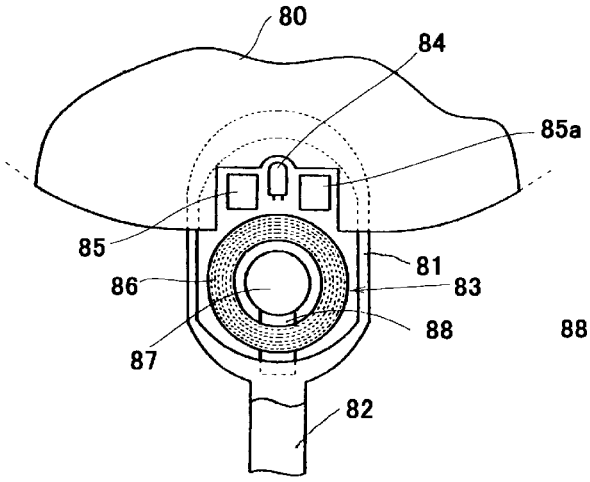
FIG. 20 is a sectional plan view showing a generator as a source for the LED according to a first example.
Figure 21:
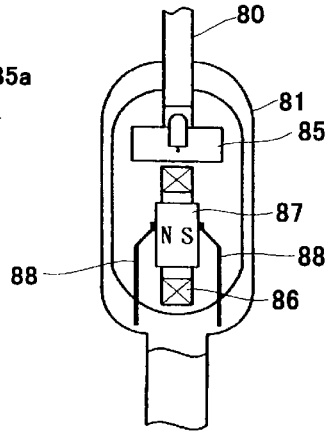
FIG. 21 is a sectional side view thereof.

FIG. 20 is a sectional plan view showing a generator as a source for the LED according to a first example, and FIG. 21 is a sectional side view thereof.

The fan comprises a fan body 80, a generator case 81 made of opaque resin and secured to the fan body 80, and a handle 82.

There is provided in the generator case 81, a generator 83, an LED 84, an electric current for operating the LED 84 and a rectifier 85*a* for rectifying the alternating current generated by the generator 83 and for supplying the rectified current to the LED 84. The generator 83 comprises an annular coil 86 secured to the inside wall of the generator case 81, and a permanent magnet 87 disposed inside the coil 86 and supported by a pair of spring plates 88 so as to be incorporated in the axial direction. When the fan is swung for creating a an airflow, the permanent magnet 87 is reciprocated, thereby generating alternating current. The alternating current is a rectified by the rectifier 85 to generate direct current which is fed to the LED 84 to radiate light.

Figure 22:
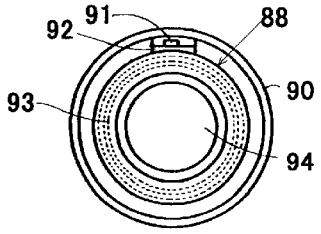
FIG. 22 is a sectional plan view of a second example of the generator.
Figure 23:
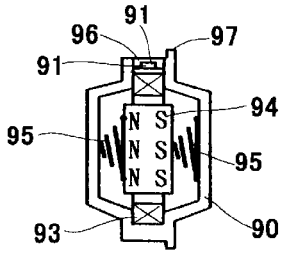
FIG. 23 is a sectional side view.

FIG. 22 is a sectional plan view of a second example of the generator, and FIG. 23 is a sectional side view.

A generator 88 is provided in a generator case 90 which is formed by adhering a pair of dish like plastic plates. There is provided in the generator case 90, a small LED 91 mounted on a substrate 92, a coil 93, a permanent magnet 94 supported by a pair of coil springs 95, and an opening 96 for discharging the light emitted from the LED 91.

Since the case 90 is small in size, the case can be engaged in a hole formed in the fan body (not shown). When the case is mounted in the hole, a flange 97 of the case contacts with the surface of the fan body, and the opening is positioned at a central position of the thickness of the fan body.

Figure 24:
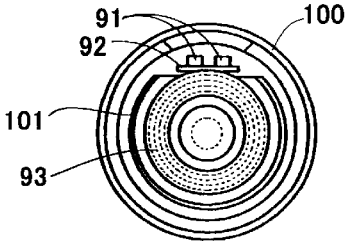
FIG. 24 is a sectional plan view of a third example.
Figure 25:
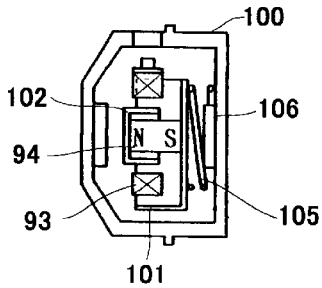
FIG. 25 is a sectional side view.

FIG. 24 is a sectional plan view of a third example, and FIG. 25 is a sectional side view. In a generator case 100, a large yoke 101 and a small yoke 102 are provided. The permanent magnet 94 is disposed in the small yoke 102, and the coil 93 is mounted between the large and small yokes 101 and 102, so that the magnetic flux is effectively applied to coil 93. A coil spring 105 is mounted on a resilient resin member 106 so that the magnet 94 and yokes 101 and 102 are prevented from striking the case. There are provided two LEDs 91.

Figure 26:
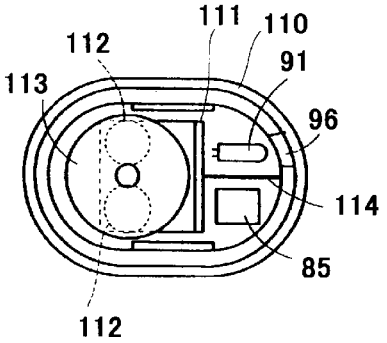
FIG. 26 is a sectional plan view of a fourth example of the generator.
Figure 27:
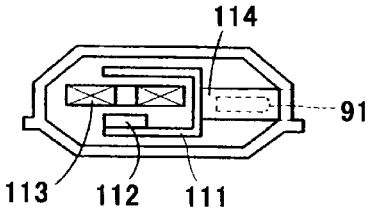
FIG. 27 is a sectional side view.

FIG. 26 is a sectional plan view of a fourth example of the generator, and FIG. 27 is a sectional side view.

In a generator case 110, there are provided a U-shaped yoke 111, a pair of flat permanent magnets 112 secured on the yoke 111 and a flat coil 113 opposite to the magnets. The yoke 111 is supported by a spring plate 114 to be vibrated in a direction parallel to the surface of the coil 113. Other parts are identified by the same reference numerals of FIGS. 20–23.

The generator case 110 is embedded in the fan body. When the fan body is reciprocated in the direction parallel to the surface of the fan, the LED 91 produces light.

Figure 28:
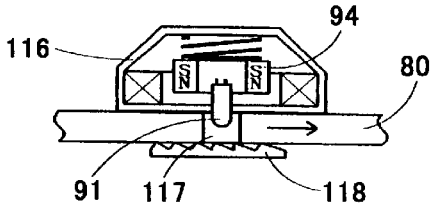
FIG. 28 is a sectional side view showing a fifth example of the generator.

FIG. 28 is a sectional side view showing a fifth example of the generator.

The permanent magnet 94 has an annular shape, and the LED 91 is provided in the magnet 94. A generator case 116 is adhered to the surface of the fan body 80. The LED 91 is inserted in a hole 117 formed in the fan body. The hole 117 is closed by a light shielding plate 118 adhered to the opposite side of the fan body 80.

Figure 29:
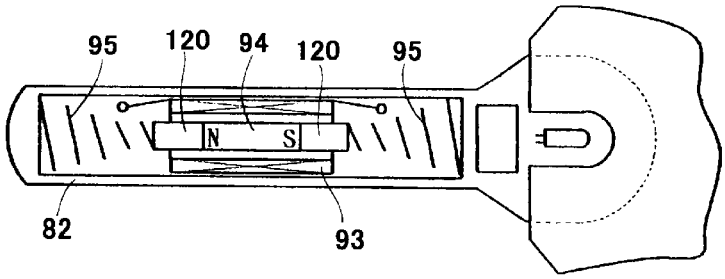
FIG. 29 is a sectional plan view of a sixth example of the generator.

FIG. 29 is a sectional plan view of a sixth example of the generator.

There is provided in the handle 82, elongated cylindrical coil 93, permanent magnet 94 having a pair of yokes 120 secured to both ends of the magnet and inserted in the coil 93. The magnet 94 is held by a pair of coil springs 95 so as to be moved in the axial direction.

Figure 30:
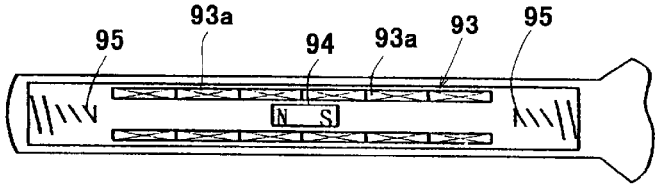
FIG. 30 is a sectional plan view showing a seventh example of the generator.

FIG. 30 is a sectional plan view showing a seventh example of the generator.

Cylindrical coil 93 comprises a plurality of unit coils 93*a*. Adjacent unit coils 93*a* are different in winding direction. The permanent magnet 94 has a length approximately equal to that of the unit coil 93*a*, and is inserted in the coil 93 to be moved in the axial direction. At both ends of the handle 82, a pair of springs 95 are provided to return the magnet 94.

Figure 31:
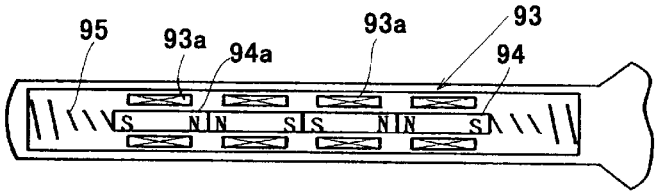
FIG. 31 shows an eighth example.

FIG. 31 shows an eighth example. The generator comprises four cylindrical coils 93*a* removed from each other. The permanent magnet comprises four magnets 94*a* adhered to each other at the same pole.

Figure 32:
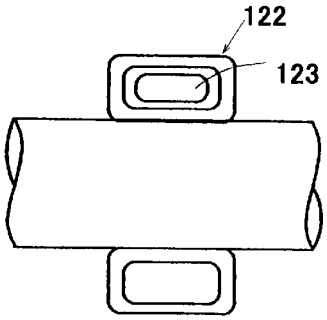
FIG. 32 is a sectional plan view of a ninth example.
Figure 33:
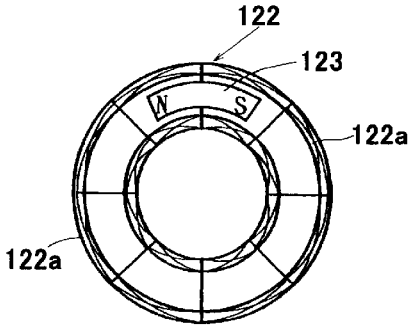
FIG. 33 is a sectional view of a toroidal coil.

FIG. 32 is a sectional plan view of a ninth example, and FIG. 33 is a sectional view of a toroidal coil.

The toroidal coil 122 comprises a plurality of cylindrical coils 122*a*. An arcuated permanent magnet 123 is inserted in the coil 122 to be rotated in the coil. The generator generates an electric current by rotating the handle about the axis.

Figure 34:
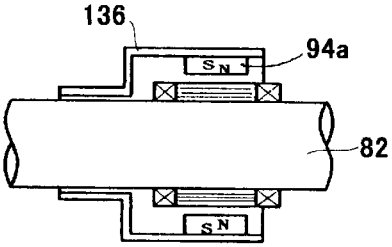
FIG. 34 is a sectional plan view of a tenth embodiment.
Figure 35:
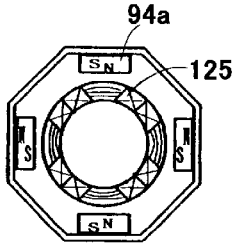
FIG. 35 is a sectional view.

FIG. 34 is a sectional plan view of a tenth embodiment, and FIG. 35 is a sectional view.

A cylindrical coil 125 comprising four coils is secured on the handle 82. A cylindrical yoke 136 is rotatably mounted on the handle 82. Four permanent magnets 94*a* are secured to the inside wall of the yoke 136.

Figure 36:
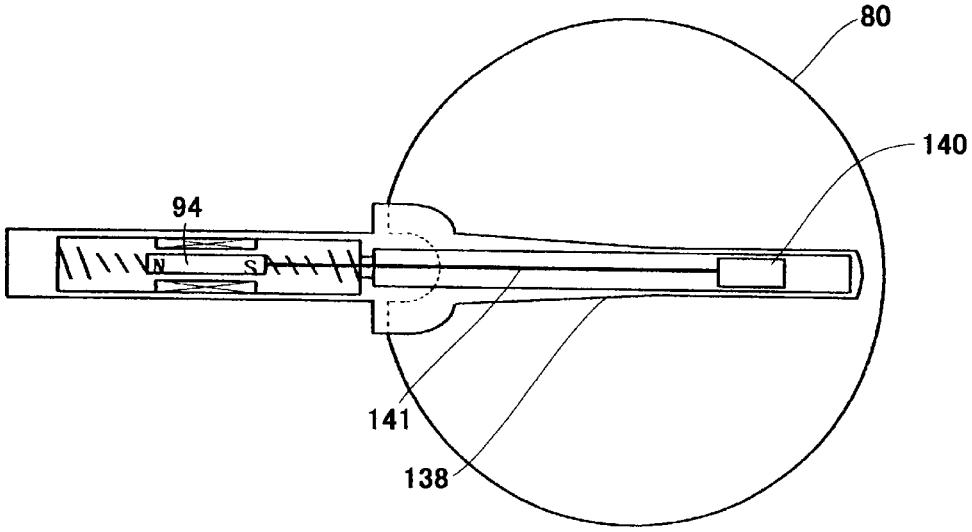
FIG. 36 is a sectional plan view of an eleventh example.

FIG. 36 is a sectional plan view of an eleventh example.

The generator is substantially the same as that of FIG. 29. A guide pipe 138 is provided in the fan body 80, and a weight 140 is slidably provided in the guide pipe. The weight 140 is connected to the permanent magnet 94 by a rod 141.

Figure 37:
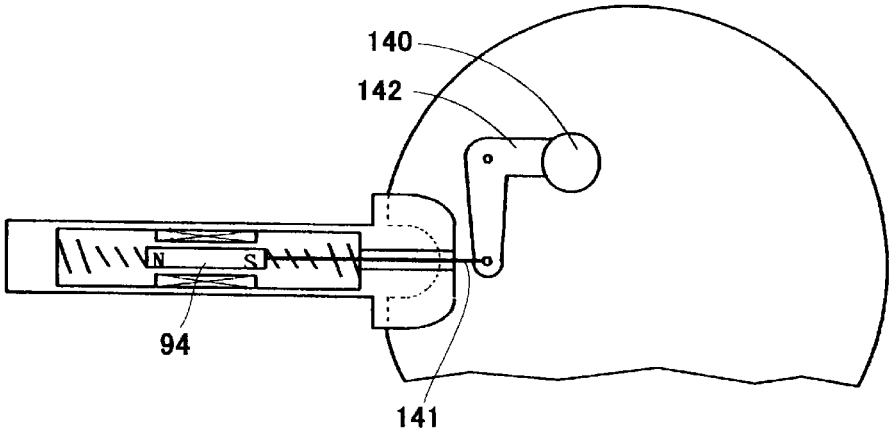
FIG. 37 is a sectional plan view of a twelfth example.

FIG. 37 is a sectional plan view of a twelfth example.

In the example, the weight 140 is connected to the permanent magnet 94 by a lever 142 and the rod 141.

Figure 38:
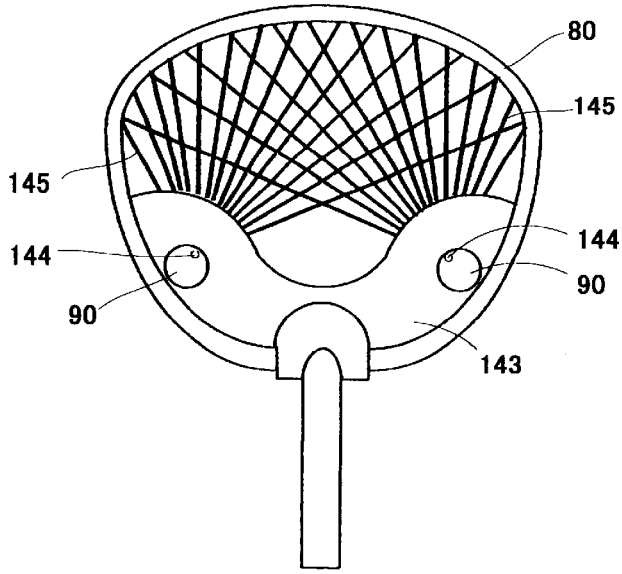
FIG. 38 is a plan view of a thirteenth example.
Figure 39:
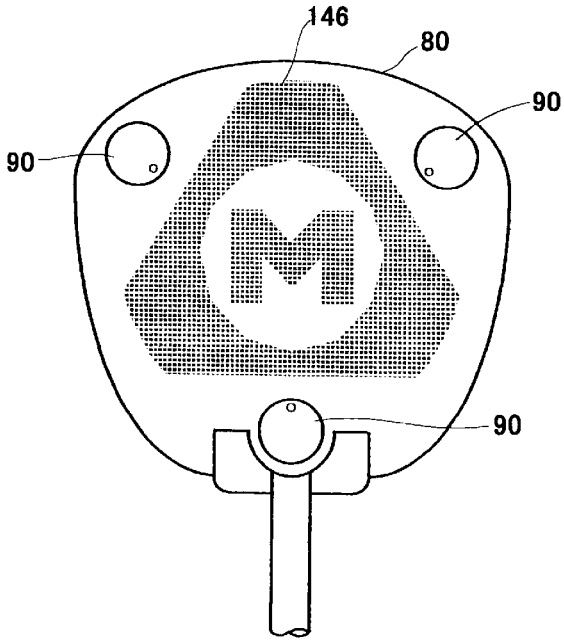
FIG. 39 is a perspective view of a fourteenth example.

FIG. 38 is a plan view of a thirteenth example, and FIG. 39 is a perspective view of a fourteenth example.

In the fan body 80 of FIG. 38, two generator cases 90 shown in FIGS. 22 and 23 are embedded at a base portion

143. Each generator case 90 has a light discharge opening 144. A plurality of radial ribs 145 are provided in the fan body 80 from the opening 144. The generators in the generator cases 90 emit different colors.

In the fan body 80 of FIG. 39, three generator cases 90 are embedded. A pattern 146 is provided in the fan body 80. The generators in the cases 90 produce three primary colors which illuminate the pattern 146.

Figure 40:
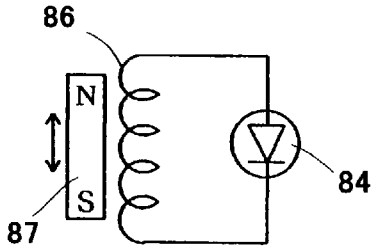
FIGS. 40, 41 and 42 show different kinds of the electric circuit.
Figure 41:
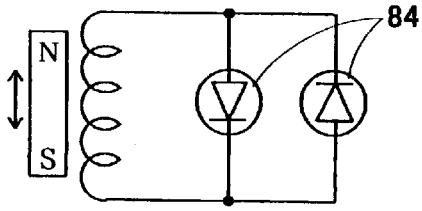
Figure 42:
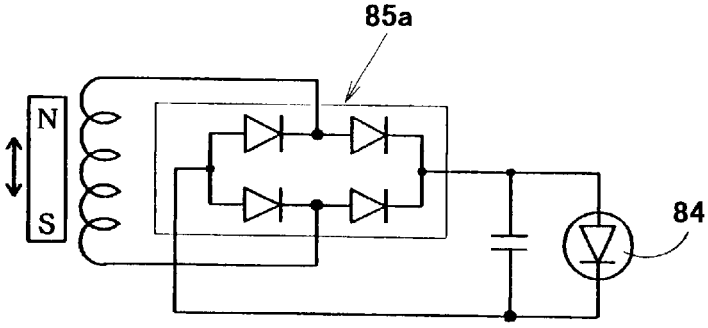

FIGS. 40, 41 and 42 show different kinds of the electric circuit 85. The circuit of FIG. 40 operates the LED 84 with a current of one of polarities of the alternating current.

Two LEDs 84 of the circuit of FIG. 41 are alternately operated by a current of both polarity of the alternating current.

The circuit of FIG. 42 is provided with the rectifier 85*a*.

In accordance with the present invention, there is provided a fan which has beautiful radiation of light and various light emission effects, and may be manufactured at low cost.

While the invention has been described in conjunction with preferred specific embodiment thereof, it will be understood that this description is intended to illustrate and not limit the scope of the invention, which is defined by the following claims.

What is claimed is:

1. A fan comprising:

a fan body made of a transparent sheet;

a gripping member provided at a base portion of the fan body so as to be gripped by a hand of a user for swinging the fan body;

at least one LED for illuminating the fan body;

source for operating the LED;

at least one irregular portion formed in the fan body;

the irregular portion having a sectional shape in section taken along an optical axis;

a width of the sectional shape being reduced toward the advance direction of the light so as to emit light.

2. The fan according to claim 1 wherein the fan body is made of resin.

3. The fan according to claim 1 therein the source is at least one battery.

4. The fan according to claim 1 further comprising a pattern provided in the fan body so as to be illuminated by light emitted from the LED.

5. The fan according to claim 1 wherein the LED is disposed at the base portion of the fan body.

6. The fan according to claim 1 further comprising a motion sensor provided in the gripping member for detecting the motion of the fan body to control light emitting condition of the LED.

7. The fan according to claim 1 wherein the gripping member is a handle secured to the fan body.

8. The fan according to claim 7 wherein the source is provided in the handle.

9. The fan according to claim 1 wherein the source is a generator generating electric current by motion of the fan body.

10. The fan according to claim 9 wherein the generator is provided in the fan body.

11. The fan according to claim 9 wherein the generator comprises a coil and a permanent magnet which is provided to be moved with respect to the coil.

12. The fan according to claim 1 further comprising a skeleton provided in the fan body.

13. The fan according to claim 12 wherein the skeleton comprises a plurality of ribs radially extended from the base portion of the fan body and an annular frame including an arcuated portion integral with a tip end of each of the ribs, the ribs and the frame being made of transparent resin.

14. The fan according to claim 13 wherein the ribs are provided for leading light emitted from the LED to the frame.

15. The fan according to claim 13 wherein the arcuated portion is provided to be illuminated by the light of the LED.

16. The fan according to claim 13 further comprising a lateral rib integral with the ribs.

17. The fan according claim 16 wherein the lateral rib is provided to be illuminated by the light of the LED.

18. The fan according to claim 13 further comprising transparent sheets adhered on both sides of the skeleton.

19. The fan according to claim 18 wherein a space is formed between the sheets and between adjacent ribs.

20. The fan according to claim 12 wherein the skeleton has irregular portions to be illuminated by light emitted from the LED.

21. The fan according to claim 20 wherein the irregular portions include portions different in section are of the skeleton.

22. The fan according to claim 1 further comprising a shield member for shielding leaking light of the LED.

23. The fan according to claim 22 wherein the shield member is provided for slightly leaking the light of the LED.

* * * * *